United States Patent [19]

Van Hout et al.

[11] Patent Number: 4,710,858

[45] Date of Patent: Dec. 1, 1987

[54] PANEL DISPLAYS, FRAMED LIGHTED SWITCH ACTUATORS THEREFOR

[76] Inventors: James E. Van Hout, 676 Briarvale Dr., Auburn Heights, Mich. 48057; Frank H. Klein, 10020 Westleigh Dr., Huntsville, Ala. 35803

[21] Appl. No.: 4,449

[22] Filed: Jan. 20, 1987

[51] Int. Cl.[4] ..... F21V 33/00

[52] U.S. Cl. ..... 362/95; 362/800; 200/315

[58] Field of Search ..... 362/32, 85, 95, 800; 200/315, 313

[56] References Cited

U.S. PATENT DOCUMENTS

| | | | |
|---|---|---|---|
| B470,899 | 3/1976 | Ohashi | 200/315 |
| 3,598,950 | 8/1971 | Ohashi | 200/315 |
| 4,191,873 | 3/1980 | Woodard | 200/315 |
| 4,347,417 | 8/1982 | Sorenson | 200/315 |
| 4,454,400 | 6/1984 | Sorenson | 200/315 |
| 4,480,292 | 10/1984 | Schuder | 362/95 |

FOREIGN PATENT DOCUMENTS

| | | | |
|---|---|---|---|
| 1665631 | 3/1972 | Fed. Rep. of Germany | 362/32 |

*Primary Examiner*—Craig R. Feinberg
*Assistant Examiner*—David A. Okonsky

[57] ABSTRACT

Backlighting from a circuit board mounted below a panel display is prevented from seeping around the edges of control actuators which rely on the backlighting to illuminate legends on the face of the actuators. A continuous frame and a layer of foam are disposed about the periphery of the actuators for blocking the seepage of backlighting and half bearings are fixedly attached to the actuators in a manner permitting rotation of the actuators within openings in an escutcheon plate even though the frame is attached to the periphery of the actuators.

5 Claims, 4 Drawing Figures

PANEL DISPLAYS, FRAMED LIGHTED SWITCH ACTUATORS THEREFOR

BACKGROUND OF THE INVENTION

The present invention relates to novel lighted switch actuators and, in particular, to lighted rocker type switch actuators used in backlighting panel displays.

DESCRIPTION OF THE PRIOR ART

In panel displays such as a lighted control panel of a car radio, rocker type actuators, namely rocker and paddle actuators, have been employed to actuate switches mounted on a printed circuit board. Usually, legend(s) on the face of these actuators indicating what function(s) the actuator controls is illuminated by light sources mounted on the printed circuit board providing backlighting directed towards the panel display and actuators mounted thereon. These actuators are normally made of an injection-molded plastic which is opaque, but the legends formed on the face of the actuators are translucent so as to permit the backlighting from the printed circuit board to shine through illuminating the legend.

Since backlighting is used to illuminate the legend, seepage of light around the edges of the actuators is a common occurrence. Such seepage can interfere with viewing the legend on the face of the actuator.

In order to eliminate or block the seepage of the backlighting past the edges of the actuator, it is desirable to place a frame around the edges of the actuator which would stop such seepage.

However, with a frame about the edges of the actuator, the rocking motion of the actuator is limited because the frame will rotate into contact with the escutcheon front plate. Normally, a shaft and bearing are established about the axis of rotation of the actuator to support the actuator and bear the applied forces used to revolve or rock the actuator. In order to place a frame around the actuator and still preserve the rocking or revolving action of the actuator, it is desirable to provide an actuator that includes a frame yet is capable of functioning normally as a rocker actuator.

To obtain the above-mentioned desiderata, a search was made for various means to prevent seepage of light about the edges of a panelled actuator. This search resulted in the structure of the present invention.

SUMMARY OF THE INVENTION

The present invention is concerned with an apparatus for enhancing the effectiveness of lighted rocker-type actuators on the face of a control panel. In this embodiment, the legends on the actuators are illuminated by backlighting from floodlighting sources mounted on a circuit board. To prevent seepage of the light about the edges of the actuators, a frame is disposed about the periphery of the actuators. To permit the actuators to function properly with a frame attached, half bearings are fixedly attached to chosen locations on the actuators in a manner permitting rotation of the actuators within openings in the control panel. Also, opaque foam is used to overlap the entire periphery of the frame.

BRIEF DESCRIPTION OF THE DRAWING FIGURES

DESCRIPTION OF A PREFERRED EMBODIMENT

Figure 1:
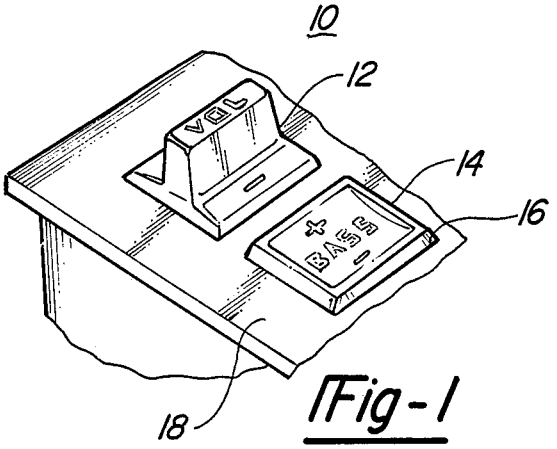
FIG. 1 is a fragmentary section of a perspective view of an instrument control panel utilizing rocker and paddle actuators of this invention.

Referring now to FIGS. 1 through 4 of the drawing, there is shown in FIG. 1 a fragmentary view of an instrument control panel 10, illustratively, for a car radio. Panel 10 employs paddle actuators 12 and rocker actuators 14 as controls which rock back and forth within openings 16 in an escutcheon plate 18.

Figure 2:
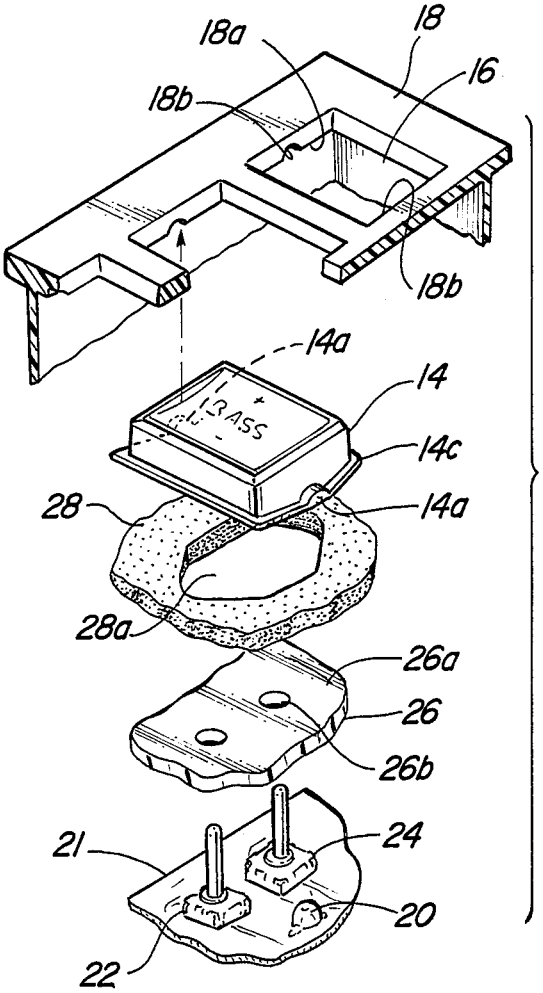
FIG. 2 is an exploded sectional perspective view of the rocker actuator of FIG. 1 embodying the principles of this invention.

FIG. 2 is an exploded view of a section of panel 10 illustrative of some of the structural features of the rocker actuator 14 in relationship to the escutcheon plate 18 and other structural components.

Figure 3:
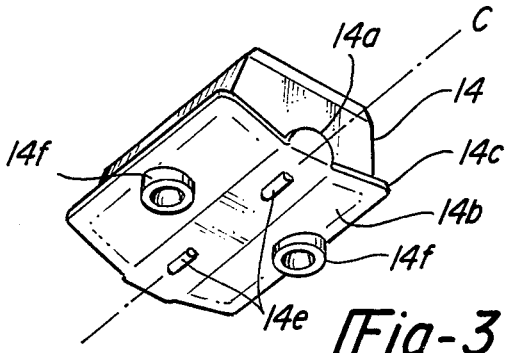
FIG. 3 is a perspective view of a rocker actuator illustrative of the offset bearing features of the present invention.

Illumination of panel 10 is accomplished by backlighting as shown in FIG. 2. Backlighting emanates from light sources 20 disposed at selected locations on the front of a circuit board 21, the circuit board being spaced apart from the escutcheon plate a chosen distance. The light from sources 20 provide adequate lighting levels so as to illuminate the legends **14*a* on the face of all the rocker and paddle actuators mounted on the escutcheon plate. The underside 14*b* as shown in FIG. 3 of the actuator 14 and all other actuators used on panel 10** are transparent, permitting light to reach the back of the legend material which is translucent surrounded by an opaque material.

Rocker actuator 14 includes a frame **14*c* which encloses the peripheral edge of actuator 14 and is intended for blocking the passage of light which may seep through the openings 16 in the escutcheon plate while actuator 14** is in both a neutral and an operating position.

Figure 4:
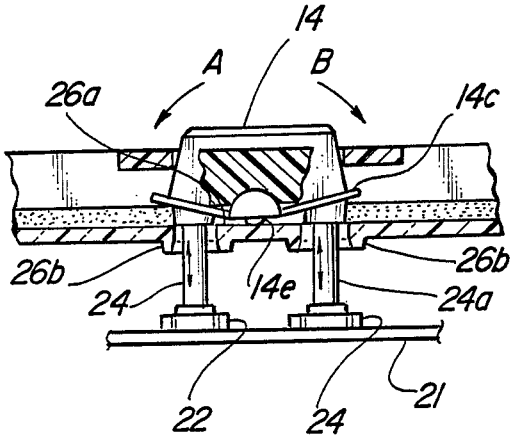
FIG. 4 is a sectional side view of the assembly shown in FIG. 2 viewed along the width of the rocker actuator showing the relationship of the components so as to aid in the explanation of the principles of the present invention.

However, due to the inclusion of the frame, which solves the light seepage problem, another problem emerges. For actuator 14 to rock back and forth within the opening 16 in the escutcheon plate, means must be provided for revolving actuator 14 about the rotational axis between two extreme positions as indicated in FIG. 4. As shown there, for actuator 14 to revolve about axis C, so as to depress plunger **22*a* of switch 22 in a direction "A" and then to depress plunger 24*a* of switch 24 in a direction "B," means must be provided to enable revolvement about axis C. One means that would permit this action would be an axial journal or shaft that would extend through actuator 14 along axis C and rotate about two spaced apart mounts about hole 16. But, such an arrangement would require the frame to be discontinuous in the region of the shaft. Light could seep around the shaft since it would be very difficult to maintain sufficiently close tolerance between the edges of actuator and the edges of hole 16** yet permit revolvement about the axial shaft.

Thus, a first pair of fixedly mounted half bearing **14*d* of a first size, each one of which being mounted at opposite locations on the frame 14*c* along axis C, which revolves within a pair of arch-shaped grooves 18*b* in a bottom surface 18*a* of escutcheon plate 18 is used along with a second pair of fixedly mounted half bearings 14*e* of a second size, each of which being mounted in line with axis C on the underside 14*b* of rocker actuator 14. As shown in FIG. 4, bearings 14*e* bear against a top surface 26*a* of a light pipe member 26**. It should be recognized by those skilled in the art that only a single half bearing could be employed to achieve a similar effect.

The light pipe member 26, a rigid transparent molded plastic structure possessing light distribution characteristics is mounted to the escutcheon in spaced-apart relationship by integrally molded standoffs, not shown. A layer of an opaque foam 28 is sandwiched between the light-pipe member and the escutcheon.

The foam is used in conjunction with the light pipe member for several purposes. Various openings **28*a* in foam 28 are provided for distributing light over the underside 14*b* of the rocker actuators 14 and the other actuators possessing legends. The foam adjacent to the openings 28*a* is used to provide a resilient reaction against the frame 14*c* of the actuators 14** to cause the actuator to return to a neutral position after being depressed and released. The foam which is opaque is also used to seal against the frame thus preventing any light seepage even when the actuator is operated.

The top surface **26*a* of the light pipe member 26 as shown in FIG. 4 provides a substantially rigid flat surface for the second pair of half bearings 14*e* to bear upon in response to the rocker actuator being depressed. A pair of transparent guide ports 26*b*, molded in light pipe member 26 below each actuator, permit interfacing the plungers of the switches with receptacle 14*f*** formed on the underside of the actuators.

To achieve the above-mentioned interactions between the various parts forming control panel 10, the circuit board 21 and the light pipe member 26 must be mounted in a manner which minimizes movement when the actuator on the escutcheon plate is depressed.

To describe the operation of the control actuators on panel 10, reference is made to FIGS. 2 and 4 which is illustrative of a two-circuit switch arrangement embodying principles of the present invention. Switch 14 is, e.g., a bass control switch on a car radio. This switch is illuminated by backlighting from light source 20. The "BASS" tone legend is illuminated along with the plus (+) and minus (−) symbols.

With the radio turned on and it is desired to increase the bass tone of the radio system, rocker actuator 14, which is shown in a neutral position is pressed on the (+) side of the legend so as to cause the bearings **14*d* to rotate clockwise in grooves 18*b* of the escutcheon and for bearings 14*c* to also rotate in place about a spot on the top surface 26*a* of the light pipe member 26. The force on the (+) side of the legend 14*a* causes the foam under that portion of the frame 14*c* to become compressed. Also, all the pretravel distance of the switch 24 is taken up causing the switch 24*a* to move from its free position to its operating point causing the circuit that increases the bass tone to "make." There's no interaction between switch 22, the switch associated with the (−) circuit, and switch 24. When the force on the (+) side of the legend is removed, the compression of the foam under the frame causes the rocker actuator to return to its neutral position. Also, the plunger 24*a*** returns to its free position and the bass increase circuit is broken.

If it is desired to reduce the bass tone, actuator 14 is pressed on the negative sign portion of the actuator 14 and the identical reaction occurs for switch 22.

While the present invention has been disclosed in connection with a preferred embodiment thereof, it should be understood that there may be other embodiments which fall within the spirit and scope of the present invention and that the invention is susceptible to modification, variation and change without departing from the proper scope or fair meaning of the following claims.

We claim:

1. An improved panel display for displaying lighted legends on rocker-type actuators used to actuate switches on a circuit board mounted below the panel display; wherein a backlighting system is employed to illuminate the legends on the actuators, the backlighting emanating from light sources on the circuit board; wherein the actuators rotate about a rotational axis within openings of an escutcheon plate of the panel display; wherein the underside and legend material of the actuators are transparent and translucent, respectively; and wherein a light pipe member is used to hold the actuators within the escutcheon plate, the light pipe member being of transparent material; the improvement comprising:

(a) means attached to the peripheral edge of the actuators for opposing seepage of backlighting through the apertures of the escutcheon plate and around edges of the actuators; and (b) means for rotating the actuators about the axis within the openings of the escutcheon while the light seepage opposing means is attached to the peripheral edge of the actuators.

2. Apparatus in accordance with claim 1 wherein the light seepage opposing means is a frame, said frame is positioned about the periphery of the actuators so as to oppose the passage of the backlighting while the actuator is in a neutral position, as well as when the actuator is operated.

3. Apparatus in accordance with claim 1 wherein said actuator rotating means is a first pair of half bearings each of which being disposed at opposite ends of the actuators so as to rotate in both a clockwise and a counter-clockwise direction within a pair of arch-shaped grooves each of which being formed on opposite sides of the escutcheon plate in line and about the rotational axis within the openings and a second half bearing means fixedly mounted on an underside of the actuators, said half bearing means being in line with the central rotational axis within the opening and disposed so as to rotate against a rigid flat surface of a top side of the light pipe member.

4. Apparatus in accordance with claim 3 wherein said half bearing means is made of a transparent material so as to permit the transmission of the backlighting to the legend on the actuators.

5. Apparatus in accordance with claim 2 wherein said means for opposing seepage of backlighting includes an opaque foam which is used to seal against an underside of the frame of the actuator thus preventing any light seepage during operation of the actuator.

* * * * *

UNITED STATES PATENT AND TRADEMARK OFFICE

CERTIFICATE OF CORRECTION

PATENT NO. : 4,710,858

DATED : Dec. 1, 1987

INVENTOR(S) : James E. Van Hout and Frank H. Klein

It is certified that error appears in the above-identified patent and that said Letters Patent are hereby corrected as shown below:

Insert on Title Page:
--Assignee: Chrysler Motors Corporation, Highland Park, MI--

Signed and Sealed this

Twenty-seventh Day of September, 1988

*Attest:*

DONALD J. QUIGG

*Attesting Officer*

*Commissioner of Patents and Trademarks*